US006138937A

United States Patent [19]

Straaten et al.

[11] Patent Number: 6,138,937

[45] Date of Patent: Oct. 31, 2000

[54] METHOD FOR OPERATING A CHEESE-PRODUCING TEXTILE MACHINE AND A SENSOR DEVICE FOR SUCH A MACHINE

[75] Inventors: Paul Straaten, Kerken; Ulrich Fechter, Mönchengladbach; Jürgen Enger, Moenchengladbach; Peter Schwartz, Mönchengladbach, all of Germany

[73] Assignee: W. Schlafhorst AG & Co., Germany

[21] Appl. No.: 09/192,964

[22] Filed: Nov. 16, 1998

[30] Foreign Application Priority Data

Nov. 15, 1997 [DE] Germany ..... 197 50 726

[51] Int. Cl.[7] ..... B65H 54/26; G01N 29/00; B65G 43/08

[52] U.S. Cl. ..... 242/473.6; 73/1.82; 198/572

[58] Field of Search ..... 242/473.6, 473.7, 242/473.8, 473.5; 198/370.07, 598, 572; 73/1.82, 181

[56] References Cited

U.S. PATENT DOCUMENTS

| | | | |
|---|---|---|---|
| 3,876,969 | 4/1975 | Price, Jr. | 367/96 |
| 4,369,873 | 1/1983 | Heuft | 198/370.07 X |
| 4,541,577 | 9/1985 | Suzuki et al. | 242/473.6 |
| 4,895,313 | 1/1990 | Burysek et al. | 242/473.6 |
| 5,582,354 | 12/1996 | Peters | 242/473.6 |
| 5,808,177 | 9/1998 | Bonnefoy | 73/1.82 |
| 5,853,137 | 12/1998 | Straaten et al. | 242/473.6 |

FOREIGN PATENT DOCUMENTS

| | | |
|---|---|---|
| 29 35 143 A1 | 3/1981 | Germany . |
| 37 31 125 A1 | 5/1988 | Germany . |
| 39 32 665 A1 | 4/1991 | Germany . |
| 195 12 891 A1 | 10/1995 | Germany . |
| 195 20 132 A1 | 12/1996 | Germany . |

OTHER PUBLICATIONS

Ultraschallschranke als Mikrosystem Author: Christoph Kuratli, Nov. 1996.

Ultraschall–Naherungsschalter Sonar–BERO 1991.

*Primary Examiner*—Michael R. Mansen

*Attorney, Agent, or Firm*—Kennedy Covington Lobdell & Hickman LLP

[57] ABSTRACT

A method for operating a cheese-producing textile machine (1), having a plurality of aligned work stations (2), a transport device (21) extending over the length of the machine for removing finished cheeses (11), and a cheese changer (23) displaceable above the work stations with an ultrasound sensor device (30) connected to the control device (38) of the cheese changer (23) for monitoring the loading state of the transport device (21). The sensor device (30, 38) is initially set to the climatic conditions of the respective place of employment by processing appropriate reference sound signals, i.e. a correction factor is determined. During operation, scanning values (TW) are then determined by means of the traveling time of the measuring sound signals of the ultrasound sensor (30) which, taking into consideration the respectively prevailing climatic conditions, permit conclusions regarding the loading state of the transport device (21) in the deposit areas of the respective work station (2).

12 Claims, 5 Drawing Sheets

METHOD FOR OPERATING A CHEESE-PRODUCING TEXTILE MACHINE AND A SENSOR DEVICE FOR SUCH A MACHINE

FIELD OF THE INVENTION

The present invention relates to a method for operating a cheese-producing textile machine, having a plurality of aligned work stations, a transport device extending over the length of the machine for removing finished cheeses, and a cheese changer displaceable along the work stations with a sensor device for monitoring the loading state of the transport device. The invention further relates to a device for executing this method.

BACKGROUND OF THE INVENTION

Cheese-producing textile machines, for example automatic cheese winders, are known, for example, from German Patent Publication DE 195 12 891 A1 or DE 195 20 133. The work stations of these textile machines, which are arranged next to each and are all of the same type, are serviced by an automatically operating service unit, for example a cheese changer.

More specifically, the cheese changer transports finished cheeses from the winding installation of a work station to a cheese transporting device which extends the length of the machine and is arranged behind the winding installations, and the cheese changer thereafter places a fresh empty bobbin from an intermediate storage assigned to the work station into the winding installation.

In order to prevent difficulties in the course of the transfer of the cheeses to the transport device which can occur, for example, if there already is a cheese on the respective place of deposit, the cheese changer in accordance with German Patent Publication DE 195 12 891 A1 has a sensor device in the form of a light scanner. The cheese transport device is scanned by this sensor device prior to initiating the cheese changing process. Thus, the cheese change is started only if it is ascertained by means of the sensor device that the respective place of deposit on the cheese transport device is empty.

A comparable sensor device is also described in German Patent Publication DE 37 31 125 A1 in connection with an open-end spinning machine. The movable service unit of this known textile machine also has a sensor device for scanning a cheese transporting device. Here, the sensor device is either embodied as a mechanical feeler device or as a photo-electrical sensor element.

However, the known sensor devices for cheese changing units were not entirely satisfactory in everyday spinning operations or have various disadvantages. For example, with mechanical sensor devices there is the danger that the relatively sensitive cheese is damaged by the mechanical feeler arm. Furthermore, such devices can cause or promote the creation of damaging slack threads.

Although these disadvantages can be avoided by photo-electrical sensor devices since such sensor devices operate contact-free, it is known that optical devices are very sensitive to dirt. Since in spinning mills it is hardly possible to avoid airborne fibers and dust contaminated with softener, photo-electrical sensor devices require regular careful maintenance, since otherwise it is hardly possible to prevent errors in the functioning of the sensor devices.

It is furthermore disadvantageous in connection with photo-electric light scanners that such sensor devices are strongly dependent on the coloration of the object to be scanned. Thus, light-colored objects are essentially more dependably detected than dark-colored objects. Matte-black objects can almost not be detected.

In addition, other sensor devices which operate without physical contact are known from general mechanical engineering in the form of so-called ultrasonic proximity switches. Such ultrasonic proximity switches are able to detect objects at distances between approximately 6 and 600 cm. Ultrasonic proximity switches are commercially available components, whose function is explained, for example, in a prospectus of the Siemens company (Siemens NS 3, 1991).

However, these ultrasonic proximity switches have the physical disadvantage that the speed with which the sound waves are propagated is a function of various environmental conditions, for example the air temperature, humidity and air pressure. Depending on the location of employment of the ultrasonic proximity switches, these environmental conditions can vary greatly. However, as a rule, the environmental conditions change only in a limited way and mostly relatively slowly at the respective locations of use.

In order to be able to compensate for these climatic conditions, the known ultrasonic proximity switches are equipped with additional temperature sensors and compensating devices, which clearly make the known ultrasonic proximity switches more expensive.

Although the employment of electro-acoustic sensor devices in connection with textile machines is basically known from German Patent Publication DE 39 32 665 A1, such known devices are not comparable with the subject of the present invention.

German Patent Publication DE 39 32 665 A1 relates to a device for the protection of people and protection against collisions of an automatically operating service unit of a ring-spinning machine. Here, the service unit has an electro-acoustic converter at the respective ends, which supplies a dual transmission sound signal and is connected with an electronic control unit. In the process, a sound measuring signal is radiated in the direction of travel, while a sound reference signal is directed to a reference reflector, for example the shop floor. The electronic control device supplies a recognition signal, or initiates a reversal of the traveling direction of the service unit if a sound signal is received prior to the end of the reference travel time, since such a sound signal suggests an obstacle in the path of the service unit. If no sound signal occurs until the end of the travel time of the reference signal, the control unit signals an error and stops the service unit.

SUMMARY OF THE INVENTION

In view of the prior art mentioned above, it is an object of the invention to provide a method for operating cheese-producing textile machines, and to provide a device for such a textile machine, which improves the known methods or devices.

In accordance with the present invention, this object is attained in a cheese-producing textile machine having a plurality of aligned work stations, a transport device extending over the length of the machine for removing finished cheeses, and a cheese changer displaceable along the work stations for transferring finished cheeses from the work stations onto adjacent cheese deposit areas of the transport device.

Briefly summarized, the present invention provides a method which basically comprises the steps of providing an ultrasound sensor which produces measuring sound signals, monitoring the loading state of the transport device by scanning the transport device with the measuring sound signals of the ultrasound sensor, and processing the measuring sound signals in a control device of the cheese changer. More particularly, the processing step involves determining travel times of the measuring sound signals in connection with different measuring paths of the measuring sound signals, and determining scanning values by comparing and evaluating the travel times of the measuring sound signals for the different measuring paths to indicate the loading status of the transport device in the deposit area of a respective work station, the scanning values being determined without additional measuring values indicating the ambient environmental conditions.

The method of the present invention has the advantage of employing an ultrasound transmitter, which is insensitive to dirt and is cost-efficient, for the contact-free detection of the operational state of a deposit area of the cheese transport device, without requiring further additional devices, such as temperature sensors, or the like, for compensating for the prevailing ambient environmental conditions, e.g. the respective air temperature.

Preferably, a correction value for taking into consideration the climatic conditions prevailing at the time of the ultrasonic measurement may be determined in the control device provided in the cheese changer by initially generating a reference sound signal, i.e. a sound signal which is transmitted over a measuring path, whose exact length is known. Both the length of this measuring path and the travel time of a sound signal over this measuring path under defined climatic conditions are known, whereby each deviation from the travel time of the reference sound signal immediately provides conclusions regarding the instantaneously prevailing ambient environmental conditions, which are taken into consideration as a correction value in the evaluation of the travel time of a subsequent measuring signal. By means of the appropriately corrected scanning value, a dependable statement regarding the respective loading state of the respective deposit areas of the cheese transport device is then possible.

In a further advantageous variant of the method in accordance with the invention, the maximum and minimum permissible distances between the ultrasound sensor and the transport device are first determined and fed into the control device of the cheese changer. This produces a relatively large outer tolerance band which takes into consideration all height deviations of the transport device which can occur because of machine tolerances, as well as all measurement errors on the basis of possible climatic conditions. Thereafter the control device is in effect calibrated by scanning the transport device by the ultrasound sensor, storing all scanning values within the range of the maximally permissible distance in the control device, permanently forming an average value from these actual scanning values which represents the average distance of the cheese removal belt from the ultrasound sensor of the cheese changer, and then establishing an operating tolerance range around this average value based upon height differences resulting from permissible machine tolerances.

When the cheese changer is afterwards connected with a work station in the course of the normal winding operation and the ultrasound sensor scans the transport belt, each scanning value within the operating tolerance range is evaluated as an empty cheese deposit area by the control device, and the cheese change is started accordingly. However, a scanning value below the operating tolerance range (i.e., of a lesser value) is evaluated by the control device of the cheese changer as an occupied deposit area. In this case, a cheese change is not executed. If the scanning area lies above the tolerance range (i.e., of a larger value, up to infinite), this indicates an error of the ultrasound sensor device. In this case, also, no cheese change is started and instead an error is visually and/or acoustically indicated. The method of the present invention is cost-effective and is distinguished by great dependability as well as low maintenance operation.

The present invention also provides a sensor device for use in a cheese-producing textile machine of the aforementioned type having a plurality of aligned work stations, a transport device extending over the length of the machine for removing finished cheeses, and a cheese changer displaceable along the work stations for transferring finished cheeses from the work stations onto adjacent cheese deposit areas of the transport device. In accordance with the present invention, the cheese changer is equipped with a sensor device for monitoring the loading state of the transport device which sensor device comprises an ultrasound sensor for scanning the transport device and a control device arranged on the cheese changer and connected with the ultrasound sensor for processing sound signals from the ultrasound sensor based upon the prevailing ambient environmental conditions. This device has the advantage that important elements of the monitoring system, specifically the control device, are already present at the cheese changer and can be used without any extensive structural outlay. It is merely necessary to adapt the software of the existing control device of the cheese changer to the ultrasound sensor. Here, the computing capacity of the control device is sufficient in any case to take on this additional job without problems.

In an advantageous embodiment, the ultrasound sensor is arranged for in effect calibrating the ultrasound sensor device, by initially transmitting a reference sound signal which is converted into a correction value in the control device. In particular, by means of the travel time of the reference sound signal, the control device forms conclusions regarding the prevailing climatic conditions. During the normal operation of the cheese changer this correction value is subsequently taken into consideration in the evaluation of the travel time of a measuring sound signal.

In a preferred embodiment, a reference path is formed in the scanning range of the ultrasound sensor. More specifically, a sound-reflecting component, for example arranged on a manipulating device of the cheese changer, whose distance from the ultrasound sensor is necessarily preset because of the structure and is therefore exactly known, is pivoted into the sound cone of the ultrasound sensor, or respectively passes through the scanning area in the course of the operation.

In one advantageous embodiment, a bobbin guide wire, rotatably arranged at the end of the cheese guide arm of the cheese changer, forms the reflector for the sound cone of the ultrasound sensor. Since the bobbin guide wire is automatically pivoted through the area of the sound cone of the ultrasound sensor during each bobbin deposit, and the distance of the bobbin guide wire from the ultrasound sensor is known, it is possible without any additional outlay to perform a reference measurement during each bobbin changing process and, if necessary, to go over the correction value again.

In an alternative embodiment, the reflector element is an angle plate arranged on the cheese guide arm of the cheese changer, which is displaced into the sound cone of the ultrasound sensor when the cheese guide arm is pivoted. Such an embodiment of the reflector only requires a very low outlay and permits a dependable reference sound measurement.

It is also possible in principle for another component to be possibly additionally installed on the cheese changer, to constitute a reflector for forming a reference path.

The distance of the ultrasound sensor from the cheese transport belt should advantageously be selected to be such that the sound cone in the deposit areas of the cheeses on the cheese transport device has a width which approximately corresponds to the division of the work stations of the textile machine. In this manner, it is assured that when the cheese changer is locked to one work station, the ultrasound sensor always monitors a sufficiently large sector of the deposit area.

Further details, features and advantages of the invention will be explained and understood from the following description of an exemplary embodiment in conjunction with the accompanying drawings.

DETAILED DESCRIPTION OF THE PREFERRED EMBODIMENT

Figure 1:
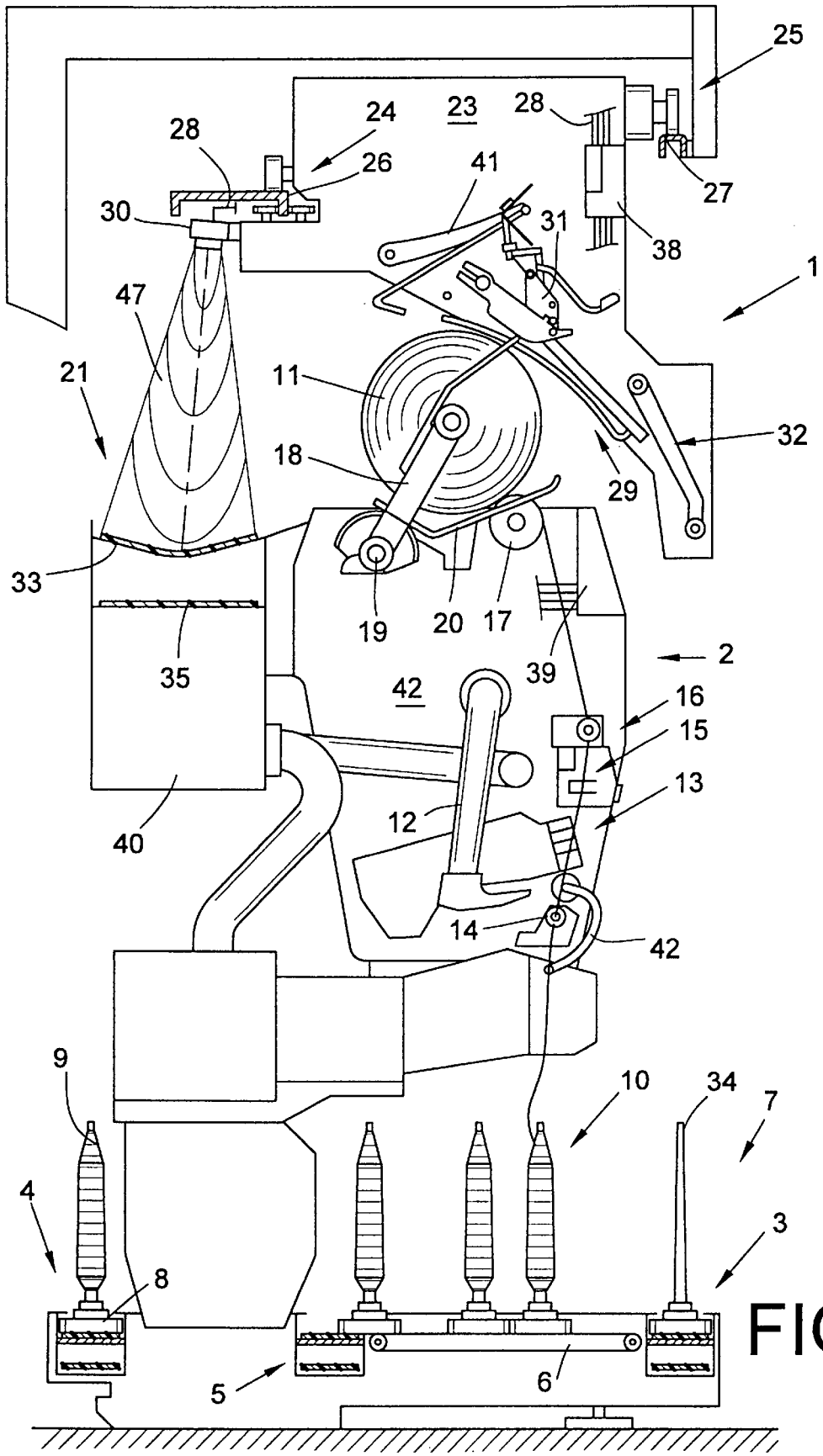
FIG. 1 is a lateral cross-sectional view of a cheese-producing textile machine with a cheese changer in accordance with the present invention positioned at a work station for scanning the cheese transport device by means of an ultrasound sensor.

Referring now to the accompanying drawings and initially to FIG. 1, one winding station 2 of a textile machine, identified as a whole by 1, in the present case an automatic cheese winder, is represented in a lateral view in FIG. 1. It is known that such winding machines have a plurality of work stations 2 of the same type which are arranged in alignment next to each other and are supplied with supply bobbins by means of a cop and tube transport system 3 forming a part of the machine.

Of this extensive cop and tube transport system 3, only the cop delivery path 4 which extends over the full length of the machine, the reversing cop supply path 5 which extends immediately behind the winding stations, one of the transverse transport paths 6 leading to the winding stations 2, and the empty tube return path 7 are represented in FIG. 1. Spinning cops 9, standing upright on transport plates 8, which have been produced on and supplied from a ring-spinning machine (not represented), and unwound empty tubes 34, also supported upright on transport plates 8, are transported on this transport system 3.

The spinning cops 9 delivered along the delivery path 4 are transferred in a known manner onto the supply path 5 and therefrom onto the individual transport paths 6 at each winding station 2 to be presented in an unwinding position 10 of each winding station 2 for rewinding into large volume cheeses 11. In a known manner only schematically represented in the drawings, the individual winding stations have different devices, which assure an orderly operation of these work stations.

By way of example, each winding station 2 comprises a suction nozzle indicated in FIG. 1 at 12, a splicing device at 13, a yarn tensioning device at 14, a yarn cleaner with a yarn cutting device at 15 and a waxing device at 16. During the winding process, a bobbin drive drum 17 drives the cheese 11 by means of a frictional connection, while the cheese 11 is held in a creel 18 which is seated to be pivotable around a shaft 19. A pivot plate 20 is arranged underneath the creel 18 and can also be pivoted around the pivot shaft 19.

A cheese transport device 21 extends behind the winding stations 2, on which the finished cheeses 11 are transferred and then transported to a loading station (not represented) located at the end of the machine. Such cheese transport devices 21 are known and, as a rule, have an endless conveyor belt extending in an upper transport run 33 formed as a trough in a V-shape and a lower return run 35.

Figure 2:
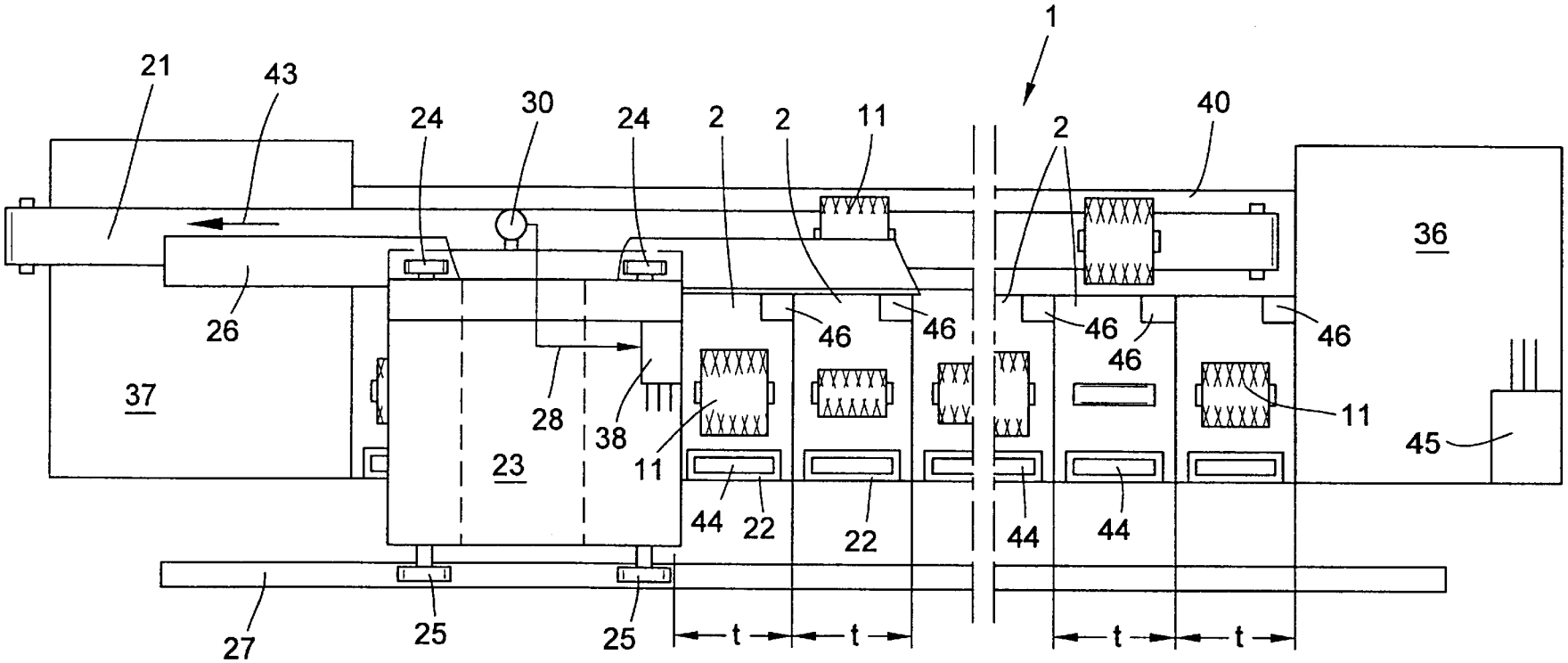
FIG. 2 is a schematic top plan view of the cheese-producing textile machine of FIG. 1.

In addition, each winding station 2 has an intermediate storage location 22, shown in FIG. 2 but not represented in FIG. 1, in which empty cheese tubes 44 are stored in a ready position for delivery into winding position. Furthermore, the individual winding stations 2 are each equipped with internal winding station computers 39, which check the rewinding process and are connected with a central control unit 45 of the winding machine 1.

The winding stations 2 are serviced by a service unit, for example a cheese changer 23. Specifically, the cheese changer 23 is arranged to be movable above the winding stations by travel of its running gear 24, 25 on tracks 26, 27, and is operative at each station to transfer cheeses 11, which have reached a defined diameter, onto the cheese transport device 21, and thereafter to transfer a fresh empty replacement tube 44 into the creel 18 from the intermediate storage 22.

For the sake of clarity, only the most important service elements of the changer unit 23 have been represented in FIG. 1, i.e. the creel opener 29, the creel lifter 32, the empty tube gripper 31 and the bobbin guide arm 41. A representation of the remaining known service elements, for example the representation of a device required for making a head winding, arranged at such cheese changers, has been intentionally omitted.

FIG. 2 schematically shows a top view of the automatic cheese winder 1. Such automatic cheese winders 1 have end frames 36, 37, in which are housed the normal drive and control devices, and the suction devices which are connected with each other by means of a suction traverse 40. A plurality of winding station housings 42 (FIG. 1) are fastened in a row next to each other on the suction traverse 40. The cheese transport device 21 is installed above the suction traverse 40 and behind the winding devices of the winding stations 2. As shown in FIG. 2, the transport direction of the transport device 21 is indicated by the arrow 43.

A cheese changer 23 is seated above the winding stations 2, movable on tracks 26, 27, which takes finished cheeses 11 out of the creel 18 and transfers them to the cheese transport device 21.

As is customary, the cheese changer 23 has its own control device 38, which is connected by means of a so-called machine bus (not represented) with the central control unit 45 of the automatic cheese winder 1 as well as with the individual winding station computers 46 of the winding stations 2.

In addition, the control device 38 of the cheese changer 23 is connected via a signal line 28 with an ultrasound sensor 30, which monitors the loading state of the cheese transport device 21. In the course of its ultrasound measurements, the ultrasound measuring device 30, 38 of the cheese changer 23 automatically takes into consideration the climatic, i.e., the ambient environmental, conditions prevailing at the location of the textile machine, as will be explained hereinafter. The various variants of the method in accordance with the invention for operating a cheese-producing textile machine will be explained in more detail below, inter alia by means of FIGS. 3, 4, and 5.

First, the ultrasound measuring device 30, 38 is "calibrated" prior to the first start-up of the textile machine. More specifically, the ultrasound measuring device 30, 38 in accordance with the present invention is set to the environmental conditions prevailing at the location of the textile machine or, for example after a prolonged stop of the textile machine, is again matched to the environmental conditions, which may have changed since the last operation. This adaptation of the ultrasound measuring device 30, 38 of the cheese changer 23 to given environmental conditions can take place in accordance with various alternative variants of the method in accordance with the invention.

Figure 3:
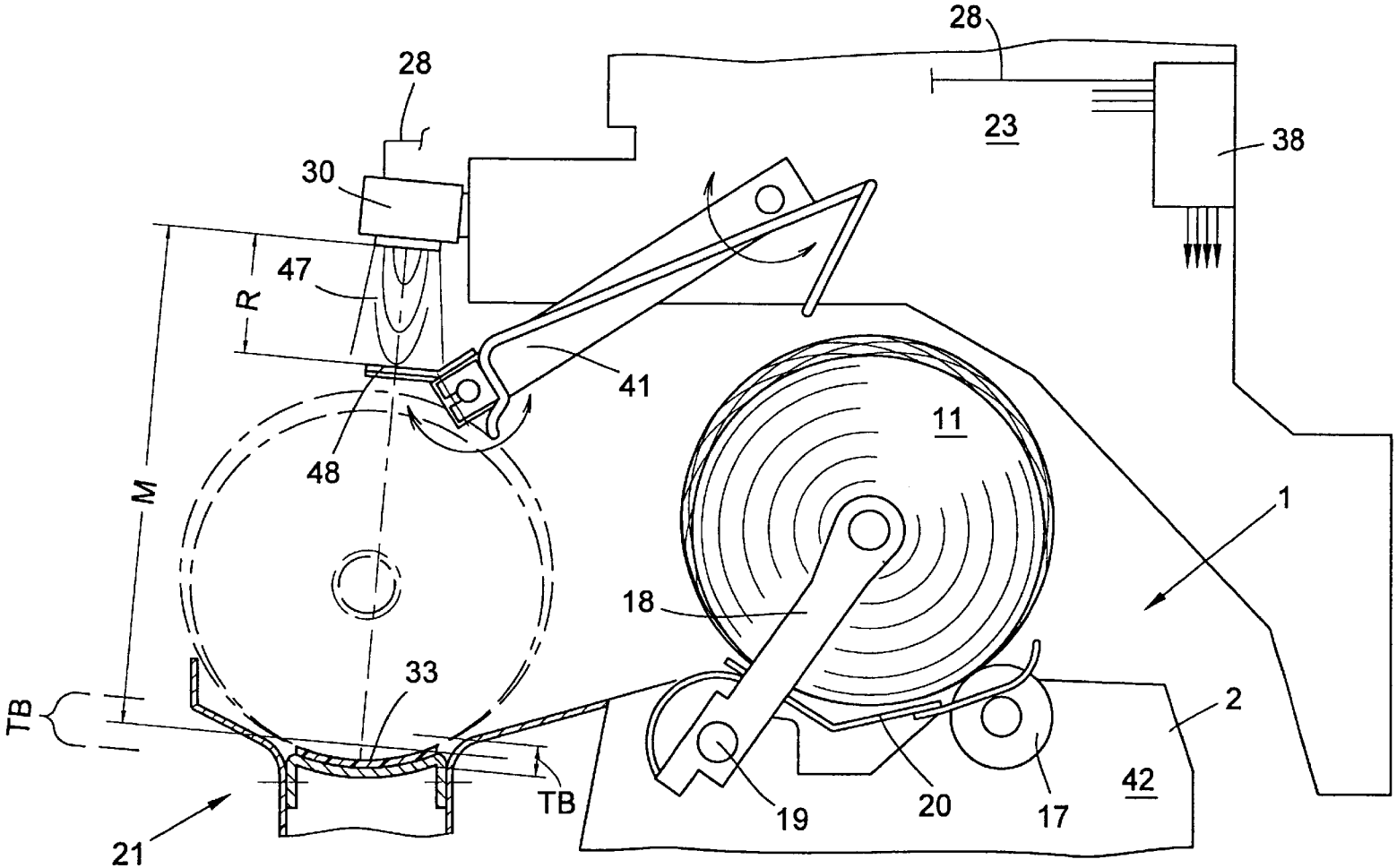
FIG. 3 is an enlarged side elevational view of one embodiment the cheese changer of the present invention, wherein the cheese guide arm is equipped with an angle plate as a reflector element.
Figure 4:
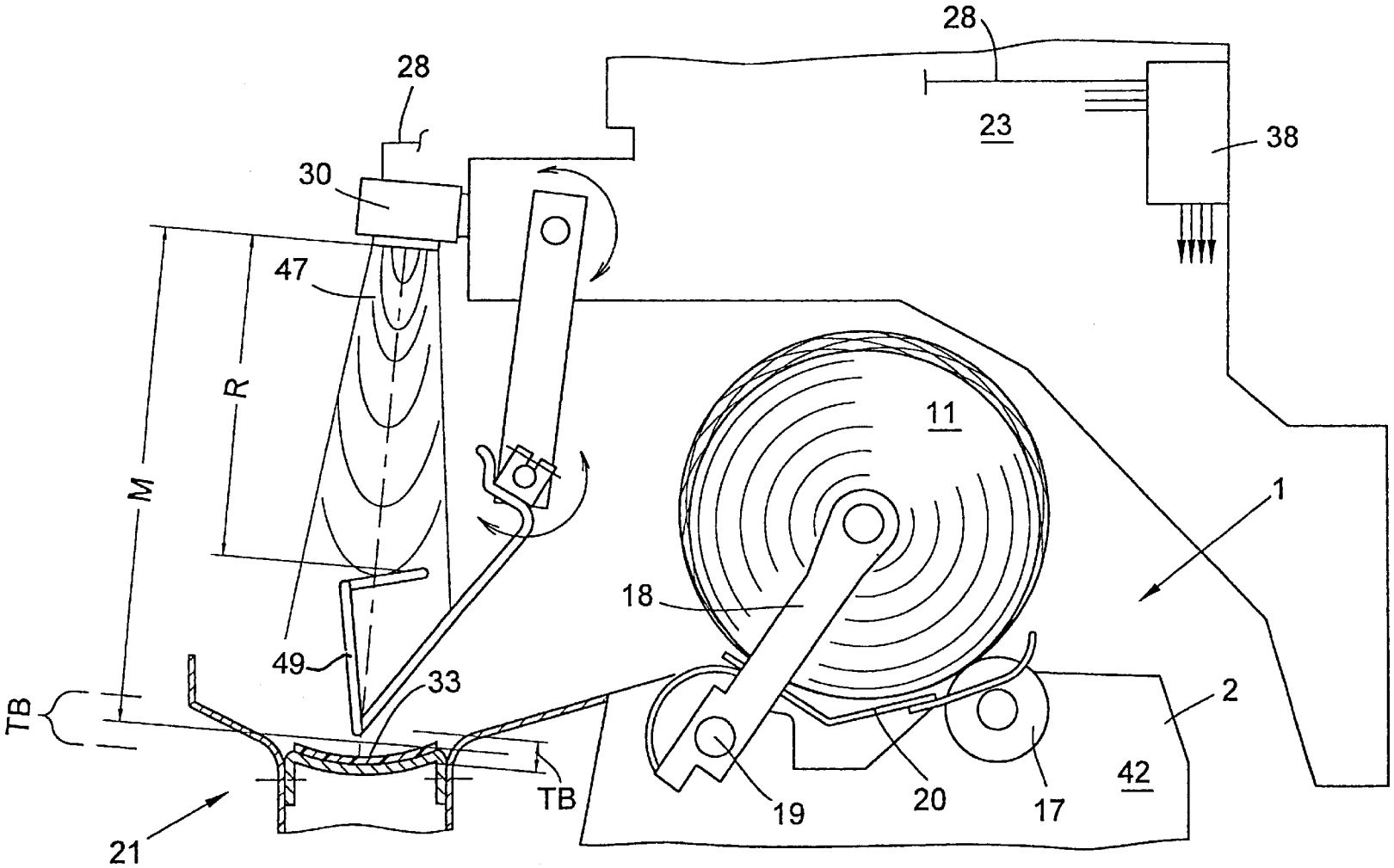
FIG. 4 is an enlarged side elevational view of another embodiment the cheese changer of the present invention, wherein the cheese guide arm is equipped with a bobbin guide wire arranged at the end of the cheese guide arm as a reflector element.

For example, as indicated in FIG. 3 or FIG. 4, in a first variant, the bobbin guide arm 41 of the cheese changer 23 is initially pivoted out of the zero position indicated in FIG. 1 into an intermediate position represented in FIG. 3 or FIG. 4, respectively. As indicated in FIG. 3, an angle plate 48 or the like is arranged on the bobbin guide arm 41, to function as a reflector for the sound cone 47 of the ultrasound sensor 30. The distance between the ultrasound sensor 30 and the angle plate 48 is predetermined by the mechanical arrangement of the structure and is therefore exactly known, whereby such distance is designated and used as a reference measuring path R. Furthermore, the traveling time of a sound signal radiated from the ultrasound sensor 30 to the reflector under known climatic conditions, which affect the propagation of the sound waves, is known.

After the reflector plate 48 has been pivoted into the reference position represented in FIG. 3, a reference sound signal is issued by the ultrasound sensor 30, which impinges on the reflector 48 and is radiated back by it to the ultrasound sensor 30. The traveling time of the reference sound signal, which is set under the prevailing climatic conditions, is compared in the control device 38 of the cheese changer 23 with the known travel time of a corresponding sound signal issued under "normal" climatic conditions, and any travel time deviations are processed in the control device 38 for determining the prevailing climatic conditions, i.e. for preparing a correction value.

The exemplary embodiment in FIG. 4 is comparable to that in FIG. 3. In the exemplary embodiment in FIG. 4, however, the reference path R is not established by the distance from the ultrasound sensor 30 of an additional angle plate 48 arranged on the cheese guide arm 41, but by the similarly known distance of the bobbin guide wire 49 rotatably arranged at the end of the cheese guide arm 41. During the cheese changing process, this bobbin guide wire 49 stabilizes conical cheeses 11 while they are being taken out of the creel 18 and transferred to the cheese transport device 21. Thus, the bobbin guide wire 49 is moved at a known distance from the ultrasound sensor 30 through the sound cone 47 of the latter.

Figure 5C:
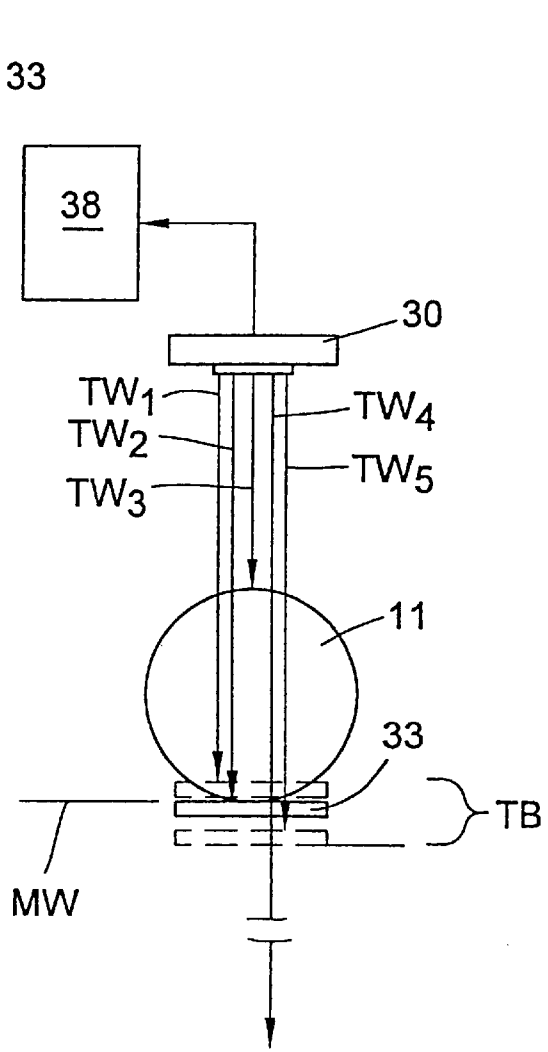
FIGS. 5*a* to 5*c* schematically show the chronological and functional progression of a variant of the method in accordance with the invention.
Figure 5B:
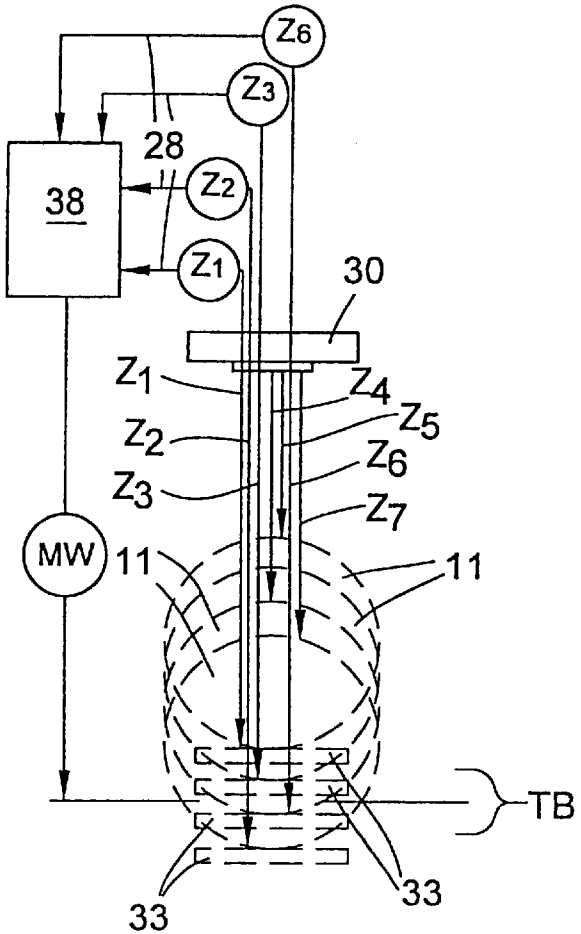
Figure 5A:
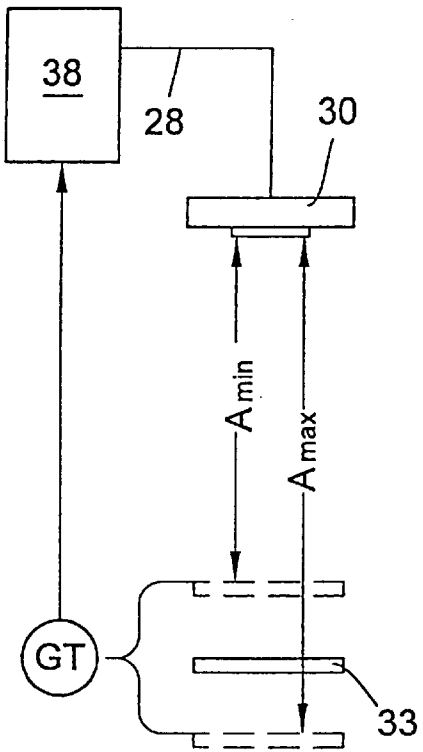

A further method for adjusting the ultrasound measuring device 30, 38 to the prevailing environmental conditions is indicated in FIGS. 5*a* to 5*c*. As represented in FIG. 5*a*, the minimally and the maximally permissible distances $A_{min}$, $A_{max}$ between the ultrasound sensor 30 and the transport run 33 of the cheese transport device 21 are initially established and fed as a relatively large outermost tolerance band GT to the control device 38 of the cheese changer 23. This large tolerance band GT takes into consideration all deviations occurring because of machine tolerances, as well as measurement errors occurring on the basis of the climatic conditions.

Thereafter (FIG. 5*b*), the ultrasound sensor 30 of the cheese changer 23 cyclically scans the upper transport run 33 to obtain actual scanning values $Z_1$ to $Z_7$. The scanning values located within the "large tolerance width" GT (here: $Z_1$, $Z_2$, $Z_3$, $Z_6$) are stored and are permanently processed in the control device 38 for the computation of an average value MW representing the average distance of the transport run 33 from the ultrasound sensor 30. In doing so, the measuring values $Z_4$, $Z_5$, $Z_7$ which indicate a loaded transport run 33 are not considered.

Another tolerance range TB to be applicable to the actual operation of the ultrasound measuring device 30, 38, which only takes into consideration permissible height deviations of the transport device 21 by reason of installation tolerance, is then computed around the average value MW to represent a normal deviation range in the distance of the transport run 33 from the ultrasound sensor 30.

The ultrasound measuring device 30, 38 when so adjusted in accordance with the above described variants in the method of the present invention by the constant adaptation of a respective correction value, will therefore automatically consider climatic changes at the place of employment which, as experience has shown, only take place slowly during the operation.

If, for example, a cheese 11 has reached its prescribed diameter on a winding station 2 of the textile machine 1, the cheese 11 is lifted off the drive drum 17 by means of a bobbin lifting device (not represented) and travels down, either braked or unbraked, until it comes to rest on the upper transport run 33 of the transport device 21.

At the same time, a signal is transmitted to request the cheese changer 23, which is movably disposed on the superstructure of the winding machine 1. Alternatively, the request for the cheese changer 23 can also take place anticipatorily, i.e. the request signal can already be issued before the cheese 11 has reached its final diameter.

The cheese changer 23 which, as already previously explained, has among other things manipulation devices for exchanging the finished cheese 11 for an empty tube 44, is positioned in front of the respective winding station, and a check is initially made whether the deposit area on the cheese transport device 21 behind the winding station is empty. That is, the cheese changer 23 scans the respective bobbin deposit area on the cheese transport device 21 with its ultrasound sensor 30. The scanning value measured in the course of this step is corrected, taking into consideration the climatic conditions detected by means of the previous reference sound measurement, and is compared in the control device 38 with the average distance MW between the ultrasound sensor 30 and the transport run 33 of the cheese transport device 21 and with the tolerance range TB around this average value MW to represent the normal machine tolerances in compensation for assembly-related height deviations of the transport run 33.

If the corrected scanning value TW lies within the tolerance range TB, this is interpreted by the control device 38 of the cheese changer 23 as an empty deposit place, and a cheese changing process, which is known per se and described, for example, in German Patent Publication DE 195 20 132 A1, is initiated. If the corrected scanning value TW lie below the tolerance range TB, i.e. the scanning value is less, this indicates the deposit location on the transport run is occupied by a cheese 11. Thus, in such case, the cheese changer 23 does not initiate a cheese change.

Scanning values lying above the tolerance range TB suggest an interference with the ultrasound measuring device. Possible causes of this can be, for example, a bent sensor holder, a false sensor setting, a defective sensor or the like. In this case, also, no cheese change takes place. Instead, the cheese changer 23 initiates a signal to indicate such an interference visually and/or acoustically.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for initiating the loading of a cheese onto a transport device of a cheese-producing textile machine, comprising the steps of:

(a) measuring in normal environmental conditions with an ultrasonic sensor a normal value representing a predefined fixed distance; and, (b) thereafter, (i) measuring in ambient environmental conditions with the ultrasonic sensor a reference value representing the predefined fixed distance;

(ii) determining a correction value by comparing the reference value to the normal value;

(iii) measuring in the ambient environmental conditions with the ultrasonic sensor a scanning value representing the open spacing extending from the sensor in the direction toward a cheese deposit area of the transport device;

(iv) correcting the scanning value as a function of the correction value to compensate for differences between the ambient environmental conditions and the normal environmental conditions; and (v) initiating the transfer of the cheese to the cheese deposit area of the transport device if the corrected scanning value falls within a tolerance range of a predetermined value.

2. The method of claim 1, further comprising not initiating the transfer of the cheese to the transport device if the corrected scanning value exceeds the predetermined value by more than one-half of the tolerance range.

3. The method of claim 1, further comprising displaying an alert if the corrected scanning value is less than the predetermined value by more than one-half of the tolerance range.

4. The method of claim 1, wherein the normal value, reference value, and scanning value are measured in units of time.

5. The method of claim 1, wherein the transport device comprises an endless belt conveyor.

6. The method of claim 5, wherein the ultrasonic sensor is disposed on a cheese changer of the textile machine directly vertically over the endless belt conveyor.

7. The method of claim 6, wherein the cheese changer is disposed on a transport device that extends over a length of the textile machine for movement thereof to each of a plurality of work stations arranged along the length of the textile machine.

8. The method of claim 1, further comprising moving a wire guide arm of a cheese changer of the textile machine into a predetermined position relative to and within a sound cone of the ultrasonic sensor, the predefined fixed distance comprising the distance between the sensor and the wire guide arm disposed in the predetermined position.

9. The method of claim 1, further comprising moving a reflector disposed on a cheese changer of the textile machine into a predetermined position relative to and within a sound cone of the ultrasonic sensor, the predefined fixed distance comprising the distance between the ultrasonic sensor and the wire guide arm disposed in the predetermined position.

10. A method for initiating the loading of a cheese onto a transport device of a cheese-producing textile machine, comprising the steps of:

(a) measuring in normal environmental conditions with an ultrasonic sensor a normal value representing a predefined fixed distance; and, (b) thereafter, (i) measuring in ambient environmental conditions with the ultrasonic sensor a reference value representing the predefined fixed distance;

(ii) determining a correction value by comparing the reference value to the normal value;

(iii) measuring in the ambient environmental conditions with the ultrasonic sensor a scanning value representing the open spacing extending from the sensor in the direction toward a cheese deposit area of the transport device;

(iv) correcting a predetermined value as a function of the correction value to compensate for differences between the ambient environmental conditions and the normal environmental conditions; and (v) initiating the transfer of the cheese to the cheese deposit area of the transport device if the scanning value falls within a tolerance range of the corrected predetermined value.

11. A cheese-producing textile machine comprising:

(a) a finished cheese transport device, (b) a cheese changer, (c) an ultrasonic sensor, and (d) a controller connected to said cheese changer for controlled actuation thereof and connected to said ultrasonic sensor for receiving input therefrom, said controller including, (i) means for determining a correction value by comparing a normal value, representing a predefined fixed distance measured with said ultrasonic sensor in normal environmental conditions, to a reference value representing the predefined fixed distance measured in ambient environmental conditions with the ultrasonic sensor;

(ii) means for correcting a scanning value, representing the open spacing extending from said ultrasonic sensor in the direction toward a cheese deposit area of said transport device measured in the ambient environmental conditions with said ultrasonic sensor, as a function of the correction value, wherein errors in measurement resulting from differences between the ambient environmental conditions and the normal environmental conditions are compensated for; and (iii) means for initiating the transfer of a finished cheese to said cheese deposit area of said transport device if the corrected scanning value falls within a tolerance range of a predetermined value.

12. A computer program encoded in a computer readable medium which initiates the loading of a cheese by a cheese changer onto a transport device of a cheese-producing textile machine, comprising:

(a) means for determining a correction value by comparing a normal value, representing a predefined fixed distance measured with an ultrasonic sensor in normal environmental conditions, to a reference value representing the predefined fixed distance measured in ambient environmental conditions with the ultrasonic sensor;

(b) means for correcting a scanning value as a function of the correction value, the scanning value representing the open spacing extending from the ultrasonic sensor in the direction toward a cheese deposit area of the transport device measured in the ambient environmental conditions with the ultrasonic sensor, as a function of the correction value, wherein errors in measurement of the scanning value resulting from differences between the ambient environmental conditions and the normal environmental conditions are compensated for; and (c) means for initiating the transfer of the cheese to the cheese deposit area of the transport device if the corrected scanning value falls within a tolerance range of a predetermined value.

* * * * *